6/12/84 XR 4,453,769

United States Patent [19]

Ricketts et al.

[11] 4,453,769

[45] Jun. 12, 1984

[54] IN SITU OIL SHALE RETORT HAVING HORIZONTAL VOIDS WITH SIDE PILLARS

[75] Inventors: Thomas E. Ricketts, Grand Junction; Robert S. Burton, Mesa, both of Colo.

[73] Assignee: Occidental Oil Shale, Inc., Grand Junction, Colo.

[21] Appl. No.: 349,865

[22] Filed: Feb. 18, 1982

[51] Int. Cl.³ ..... E21C 41/10

[52] U.S. Cl. ..... 299/2; 299/13

[58] Field of Search ..... 299/2, 13; 102/311, 102/312

[56] References Cited

U.S. PATENT DOCUMENTS 3,661,423 5/1972 Garrett ..... 299/13 X 4,192,554 3/1980 Ricketts ..... 299/2

*Primary Examiner*—Ernest R. Purser

*Attorney, Agent, or Firm*—Christie, Parker & Hale

[57] ABSTRACT

An in situ oil shale retort is formed in a subterranean formation containing oil shale by excavating one or more horizontally extending voids across a retort site, leaving a zone of unfragmented formation having a horizontal free face adjacent such a horizontal void. In one embodiment, such a horizontal void is excavated across less than the entire width of the retort site, leaving "side pillars" of unfragmented formation spaced inwardly from adjacent side boundaries of the retort site at opposite sides of such a horizontal void. This reduces the maximum span of the horizontal void, when compared with supporting overburden above the void with one or more interior isolated pillars spaced inwardly from the side boundaries of the retort. The side pillars are explosively expanded. Then such a zone of unfragmented formation is explosively expanded toward such a horizontal void for forming a fragmented permeable mass of formation particles containing oil shale in the retort. The resulting fragmented mass can have a slightly narrowed region along the sides where the side pillars were present.

36 Claims, 4 Drawing Figures

IN SITU OIL SHALE RETORT HAVING HORIZONTAL VOIDS WITH SIDE PILLARS

BACKGROUND OF THE INVENTION

1. Field of the Invention

This invention relates to in situ recovery of shale oil, and more particularly to techniques for explosively expanding formation toward horizontal free faces within a retort site for forming an in situ oil shale retort.

2. Description of the Prior Art

The presence of large deposits of oil shale in the semi-arid high plateau region of the Western United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596, 4,043,597; 4,043,598; and 4,192,554, which are owned by the assignee of this application and incorporated herein by this reference. These patents describe in situ recovery of liquid and gaseous hydrocarbon materials from a subterranean formation containing oil shale, wherein such formation is explosively expanded for forming a stationary fragmented permeable mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the fragmented mass and introducing an oxygen-supplying retort inlet mixture into the retort to advance the combustion zone through the fragmented mass. In the combustion zone, oxygen from the retort inlet mixture is depleted by reaction with hot carbonaceous material to product heat, combustion gas, and combusted oil shale. By continued introduction of the retort inlet mixture into the fragmented mass, the combustion zone is advanced through the fragmented mass in the retort. The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

U.S. Pat. No. 4,192,554, for example, discloses a method for explosively expanding formation containing oil shale toward horizontal void spaces within a retort site to form a fragmented mass of formation particles in an in situ oil shale retort. The techniques disclosed in that patent are exemplary of a "horizontal void volume" or "horizontal free face" method of forming an in situ oil shale retort. In such a method, a plurality of vertically spaced-apart voids, each of which can have a horizontal cross section similar to that of the retort being formed, are excavated one above another within the retort site. A plurality of vertically spaced-apart zones of unfragmented formation are temporarily left between the voids. Explosive is placed in each of the unfragmented zones and detonated, preferably in a single round, to explosively expand each unfragmented zone into the voids above and/or below it to form a fragmented mass having a void volume substantially equal to the void volume of the initial mined voids. Retorting of the fragmented mass is then carried out to recover shale oil from the oil shale.

When forming an in situ oil shale retort by explosively expanding formation toward horizontal free faces, rather large underground voids may have to be excavated. For example, in the retort system disclosed in U.S. Pat. No. 4,192,554, horizontal void levels within the retort site are approximately 160 feet wide and 160 feet long with pillars to stabilize the roof. Underground void levels of this size can result in large roof spans and the possibility of unsafe working conditions unless adequate precautions are taken. One or more roof-supporting pillars are typically left temporarily in place in each horizontally extending void to minimize the extent of open span. Such load-supporting pillars can provide stability in the horizontal voids where operating personnel are present so that safety hazards, such as dangeroius rock falls, can be avoided. These pillars are explosively expanded before explosive expansion of overlying and/or underlying oil shale formation toward the excavated horizontal void, when forming the fragmented mass.

When such an excavated horizontal void has a relatively large height, say on the order of 35 feet or more, for example, the roof-supporting interior pillar or pillars left in such a void can occupy a substantial portion of the horizontal cross sectional area of the retort. For example, in the retort system disclosed in U.S. Pat. No. 4,192,554, a large centrally located support pillar approximately 70 feet wide and 116 feet long is left in one horizontal void approximately 160 feet wide and 160 feet long. Such pillars are relatively large in horizontal cross section so that the height-to-width ratio of the pillar is not excessive, and structural failure of the pillar can be avoided.

When forming an in situ retort by explosive expansion of formation toward horizontal voids, explosive charges for expanding the zones of formation toward the voids can be placed in vertical blast holes drilled in the zones of formation adjacent the voids. The blast holes are commonly spaced apart horizontally from one another in an array that extends across the entire horizontal cross section of each void, with outer rows of blast holes being at or near the vertical side boundaries of the retort site. Explosive in the blast holes adjacent the side boundaries of the retort site is not as efficient in fragmenting the oil shale as explosive in blast holes nearer the center region of the retort site because of constraining effects of the adjacent walls of unfragmented formation at the side boundaries of the retort site.

Roof-supporting interior pillars in the horizontal voids can interfere with ease of access for placement of explosive charges in the more centrally located formation beneath such pillars. Consequently, long vertical blast holes have been drilled downwardly into the formation beneath such pillars, via access provided from within a horizontal void at the next higher working level, in order to reach the formation below the pillars. It would be desirable to minimize any such difficulty in placing explosive charges in formation within the central region of such a zone of unfragmented formation, since explosive placed in such a central region is more efficient in fragmenting the formation than explosive charges placed near the side boundaries of the retort site.

SUMMARY OF THE INVENTION

Briefly, one embodiment of this invention provides a method for forming an in situ oil shale retort containing a fragmented permeable mass of formation particles containing oil shale formed within upper, lower, and side boundaries of a retort site. The fragmented mass is formed by excavating formation from within the retort site for forming at least one void extending horizontally across the retort site, leaving a zone of unfragmented formation within the retort site above and/or below the void. The void is excavated so that its roof span is less than the width of the final retort being formed, i.e., the opposite peripheral side walls of the void are spaced inwardly from adjacent side boundaries of the designed final retort site. This leaves side pillars of unfragmented formation within the retort site along opposite sides of the horizontal void. In another embodiment, side pillars can be left along all sides of the retort. The side pillars provide roof support for formation above the void. An array of explosive charges are placed in the zone of unfragmented formation adjacent the horizontal void. Edge charges at the periphery of the array are spaced inwardly from the side boundaries of the retort on the same side of the retort as the side pillars. In one embodiment, the edge charges can be spaced inwardly from all side boundaries of the retort. Explosive charges are also placed in the side pillars and detonated for explosively expanding the pillars mainly horizontally into the void. After explosive charges in the pillars are detonated, the explosive charges in the zone of unfragmented formation are detonated for explosively expanding at least a portion of the zone of unfragmented formation toward the horizontal void for forming a fragmented permeable mass of formation particles containing oil shale in the in situ oil shale retort.

In one embodiment, explosive charges are placed in vertical blast holes drilled into the zone of unfragmented formation, via access provided from within such a horizontal void. The side pillars provide sufficient roof support for unfragmented formation above the roof of the void that permits the void to have a continuous open span, free of any roof-supporting pillars in the interior of the void. Such an open span in the interior of the horizontal void permits ease of access to the adjacent zone of unfragmented formation for drilling blast holes from the adjacent void, without interference from pillars located in the interior of the void. Mining production rate also is improved. Moreover, use of explosive charges placed adjacent the final side boundaries of the retort site can be avoided. This can reduce greatly the number of blast holes drilled and the amount of explosive used, without greatly reducing the quantity of oil shale formation effectively fragmented.

DRAWINGS

These and other aspects of the invention will be more fully understood by referring to the following detailed description and the accompanying drawings, in which.

DETAILED DESCRIPTION

Figure 1:
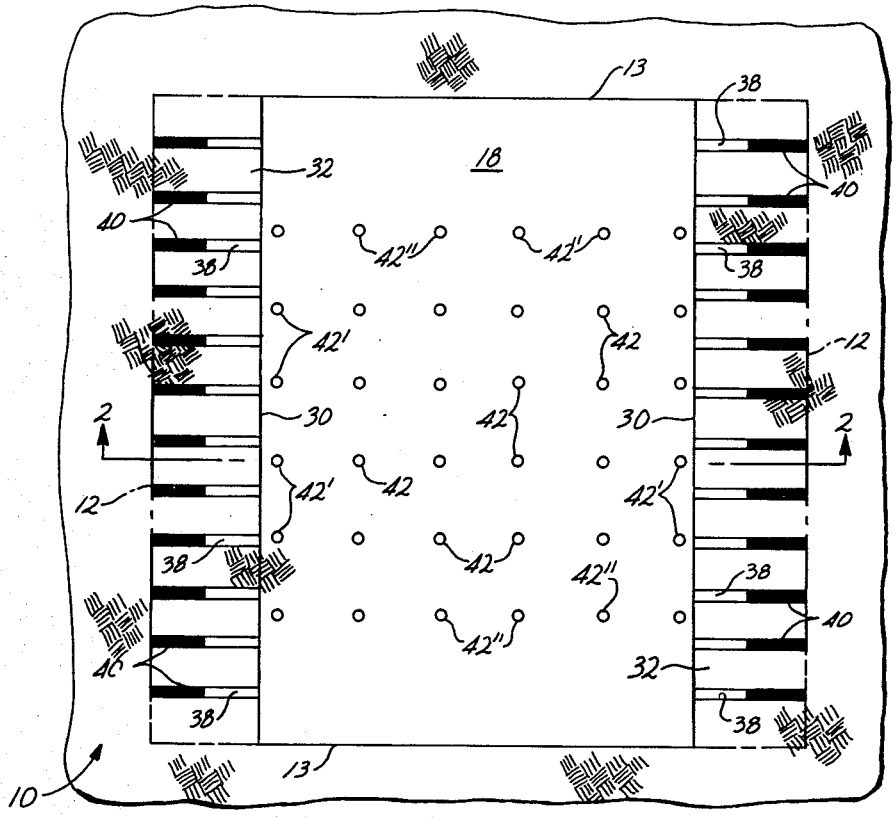
FIG. 1 is a fragmentary, semi-schematic horizontal cross-sectional view taken on line 1—1 of FIG. 2 and showing an intermediate stage during preparation of an in situ oil shale retort according to principles of this invention.
Figure 2:
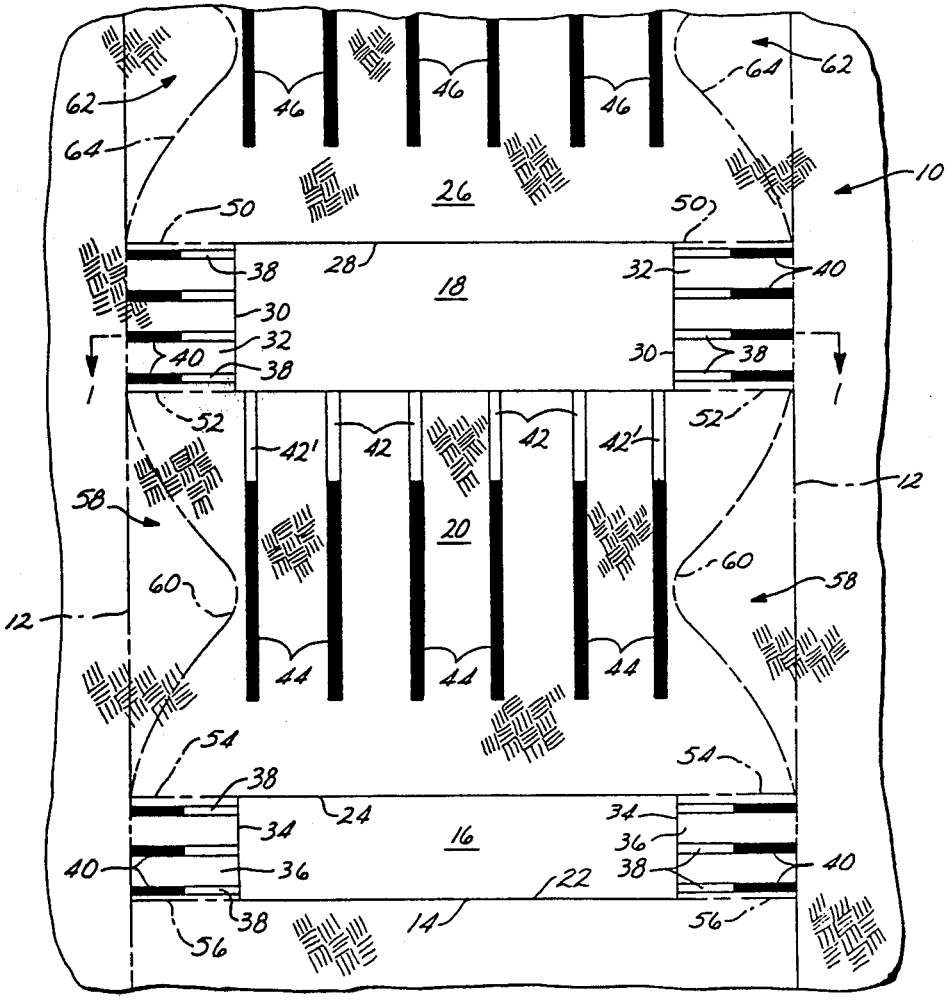
FIG. 2 is a fragmentary, semi-schematic vertical cross-sectional view taken on line 2—2 of FIG. 1.

FIGS. 1 and 2 schematically illustrate an in situ oil shale retort being formed according to principles of this invention. The retort is being formed in a subterranean formation 10 containing oil shale. The illustrated in situ retort is square in horizontal cross section, having a top boundary (not shown), a pair of vertically extending side boundaries 12 along a pair of opposite sides of the retort side (as viewed in FIG. 2), a pair of vertically extending side boundaries 13 (shown in FIG. 1) extending along the other sides of the retort site, and a lower boundary 14.

The in situ retort is formed by a horizontal free face blasting technique in which formation is excavated from within the retort site for forming a plurality of vertically spaced apart, horizontally extending voids each extending across a different level of the retort site, leaving zones of unfragmented formation within the retort site between adjacent pairs of such horizontal voids. In the illustrated horizontal free face technique, formation is excavated from a lower level within the boundaries of the retort site for forming a rectangular lower void 16 extending horizontally across a lower level of the retort site adjacent the lower boundary of the retort site. Formation is also excavated from an upper or intermediate level within the boundaries of the retort site for forming a rectangular upper or intermediate void 18 extending horizontally across the retort site above the lower void. This leaves an intervening zone 20 of unfragmented formation within the retort site between a lower horizontal free face 22 adjacent the upper or intermediate void, and an upper horizontal free face 24 adjacent the lower void. If desired, other horizontal voids can be excavated at higher elevations within the retort site. For simplicity, the retort will be described below as though the void space 18 is an upper level void. In the illustrated embodiment, an upper zone 26 of unfragmented formation is left within the retort site between an upper free face 28 adjacent the upper void and a lower free face of another horizontal void (not shown) excavated at a higher elevation within the retort site.

Each of the voids 16, 18 has a length extending between one pair of opposite side boundaries 13 of the retort being formed. The width of each void is less than the distance between the other pair of side boundaries 12 of the retort being formed. Thus, peripheral interior walls 30 along opposite sides of the upper void are spaced inwardly from the opposite side boundaries 12 of the retort site. This leaves "side pillars" 32 of unfragmented formation within the retort site between the opposite peripheral interior walls 30 of the upper void and the adjacent side boundaries 12 of the retort site. Similarly, peripheral interior walls 34 along opposite sides of the lower void are spaced inwardly from the adjacent opposite side boundaries 12 of the retort site. This leaves "side pillars" 36 of unfragmented formation within the retort site between the peripheral interior walls at opposite sides of the lower void and the adjacent side boundaries 12 of the retort site. The side pillars are integral with unfragmented formation adjacent the retort site and integral with unfragmented formation in the adjacent zones of unfragmented formation within the retort site above and below the pillars. The side pillars are preferably rectangular in horizontal cross section, with the interior walls of the pillars extending parallel to the side boundaries 12 of the retort site.

The side pillars within the upper or intermediate void provide roof support for the upper zone 26 of unfragmented formation within the retort site above the upper or intermediate void. Similarly, the side pillars within the lower void provide roof support for the intervening zone of unfragmented formation within the retort site above the lower void. The combined width of the side pillars along the sides of each void limits the open span of each void to a distance that permits safe excavation. The interior of each void can be completely open, i.e., free of any isolated or free-standing interior roof-supporting pillars that would otherwise be required for stability of the roof above each void, or a combination of side and interior pillars can be used if desired.

After excavating the horizontal voids, the retort is formed by explosively expanding unfragmented formation within the retort site toward the voids for forming a fragmented permeable mass of formation particles containing oil shale. The horizontal voids can occupy between about 15 to 35 percent of the total volume of formation within the retort site. Thus, following explosive expansion, the void spaces become dispersed throughout the fragmented mass, with the void fraction within the fragmented mass being about 15 to 35 percent. In an exemplary embodiment, the retort site can be about 160 feet long (between the side boundaries 13) and about 160 feet wide (between the side boundaries 12). The length of the upper horizontal void can be about 160 feet and the width of the upper horizontal void (between the interior walls 30 of the side pillars) can be about 100 to 110 feet, and each side pillar in the upper void can have a width of about 25 to 30 feet and a length of about 160 feet. The width of the lower void also can be from about 100 to 110 feet, with the side pillars adjacent the lower void having a width of about 25 to 30 feet each. The height of the upper void 18 can be about 30 to 36 feet and the height of the lower void 16 can be about 20 to 25 feet. The thickness of the intervening zone 20 of unfragmented formation can be about 60 to 70 feet. The total height of the retort can vary, with more horizontal voids being used as the height-to-width ratio of the retort increases. The wider the retort is made, the thicker the layer can be made and the wider the side pillars can be. The void would have to be higher to accommodate the extra rock.

An array of mutually spaced-apart horizontal blast holes 38 are drilled into each edge pillar from the space within each excavated void. These horizontal blast holes are distributed across the face of each side pillar from adjacent one side boundary 13 of the retort site to near the other side boundary 13 of the retort site. The blast holes are preferably spaced equidistantly apart along each of the side pillars. Not all of the blast holes in each pillar are shown in FIG. 1, for simplicity. The depth of horizontal blast holes extends about to the side boundaries 12 of the retort site. Separate explosive charges 40 are loaded in about the outer half of each of the horizontal blast holes. The explosive charges in the side pillars are for use in later explosively expanding the side pillars toward the adjacent void space. In each case, essentially the entire pillar (the outer boundaries of which are defined by the side boundaries 12 and 13 of the retort) is fragmented. A variety of blast hole patterns and delay sequences for the explosive charges are suitable. The drawings illustrate only a representative pattern of horizontal blast holes in which there are four vertically spaced apart rows of blast holes drilled in the side pillars within the upper void and three vertically spaced apart rows of blast holes drilled in the side pillars adjacent the lower void. Moreover, vertical blast holes can be used for explosive to blast the side pillars, although these blast holes would be of smaller diameter than the blast holes for the main charges used to blast the zones of formation toward the void spaces.

An array of horizontally spaced apart vertical blast holes 42 are drilled downwardly from the upper horizontal void into the intervening zone 20 of unfragmented formation between the upper and lower voids. In a representative embodiment, these vertical blast holes are drilled in a square array with rows and columns of blast holes having essentially equal spacings across the floor of the upper void. As best illustrated in FIG. 1, the array of vertical blast holes includes a pair of outer rows of blast holes 42' drilled down from the floor of the upper void alongside the interior walls 30 of the side pillars 32. The array of vertical blast holes also includes a pair of outer rows of blast holes 42" drilled down from the floor of the upper void, extending between the side pillars 32 and spaced inwardly from the side boundaries 13 of the retort site. These outer rows of blast holes 42" are spaced inwardly from the side boundaries of the retort site by a distance approximately equal to the width of the side pillars 32, i.e., about the same spacing from the side boundaries 13 as the spacing of the outer blast holes 42' from the side boundaries 12. Further outer rows of blast holes (not shown) could be drilled down from the floor of the upper void immediately adjacent the opposite side boundaries 13 of the retort site. However, in the illustrated embodiment, these outer rows of blast holes are eliminated, because explosive placed in blast holes extending along the side walls of the retort site can be inefficient, owing to the constraining effect of the adjacent walls of unfragmented formation.

Separate columnar charges of explosive 44 are loaded into each of the vertical blast holes so that the explosive charges occupy about the middle half of the lower zone 20 of unfragmented formation. The explosive charges placed in the outer rows of blast holes 42' and 42'' are referred to herein as edge charges, owing to their location at the periphery or edges of the array of vertical blast holes.

FIG. 2 also illustrates an example in which columnar charges of explosive 46 are placed in blast holes drilled downwardly from a void at a higher elevation in the retort site. In this illustration, the columnar charges 46 would be arrayed in a manner similar to the columnar charges 44.

The remaining upper portions of the vertical blast holes and the remaining inner portions of the horizontal blast holes are stemmed with an inert material, such as sand or gravel.

The blast holes shown in the drawings are shown out of proportion, i.e., the diameter of the blast holes is actually much smaller in relation to the horizontal and vertical dimensions of the retort than is shown in the drawings.

To form the in situ oil shale retort, the explosive charges in the blast holes in the side pillars adjacent each void are first detonated, either simultaneously or preferably with suitable time delays to promote fragmentation and proper rock movement. Preferably, detonation of explosive in the pillars adjacent the upper (or intermediate) void is simultaneous with detonation of explosive in the pillars adjacent the lower void. However, this is preferred only if the upper and lower shale layer thicknesses are about the same, i.e., a symmetrical design. Otherwise, it may be desirable to blast one level before the other. Detonators (not shown) are placed in the horizontal explosive charges in the side pillars near the side boundaries 12 of the retort site and detonation of each explosive charge is initiated along a plane defined by the side boundaries 12 of the retort for explosively expanding all of the formation within the side pillars toward the adjacent excavated void. Explosive expansion of the side pillars toward the upper void creates a new free face 50 at the top of the upper void which is, in effect, an extension of the roof or free face 28 above the void. This extension of the roof of the void extends out to the side boundaries 12 of the retort, and along a portion of the side boundaries 13 of the retort site. Similarly, explosive expansion of the side pillars toward the upper void creates a new free face 52 at the bottom of the upper void, which is, in effect, an extension of the floor of the upper void out to the side boundaries 12 and along a portion of the side boundaries 13 of the retort.

Similarly, explosive expansion of the side pillars along the sides of the lower void creates a new free face 54 at the top of the lower void which, in effect, enlarges the horizontal area of the roof 24 or free face adjacent the top of the void to the vicinity of the side boundaries of the retort site. The newly-created free faces extend outwardly to the side boundaries 12 and along a portion of the side boundaries 13 of the retort site. In a similar manner, explosive expansion of the side pillars toward the lower void also creates a new free face 56 that extends outwardly from the floor of the void and is, in effect, an extension of the floor of the void out to the side boundaries 12 and along a portion of the side boundaries of the retort.

Following detonation of explosive in the side pillars, the vertical explosive charges 44, 46 in the zone or zones of formation adjacent or above or below the void spaces within the retort site are detonated, preferably in a single round with the explosive charges in the side pillars. A time delay on the order of tens to hundreds of milliseconds is preferred between detonation of explosive charges in the side pillars and detonation of explosive charges in the zones of unfragmented formation being expanded up and down into the horizontal void spaces. Such a time delay permits the fragments of the pillars to spread across the retort site and provide a reasonably uniform void fraction distribution across the fragmented mass in the retort. Suitable time intervals for distribution of pillar fragments are described in U.S. Pat. Nos. 4,153,298 to McCarthy et al and 4,290,649 to Ricketts, which are owned by the assignee, of this application and incorporated herein by this reference.

Detonation of the explosive charges in the vertical blast holes in the intervening zone 20 of unfragmented formation explosively expands formation within the intervening zone upwardly and downwardly toward the overlying upper (or intermediate) void 18 and the underlying lower void 16. Since the pillars in the upper and lower voids have been explosively expanded a number of milliseconds earlier, some of the expansion of the intervening zone occurs toward the new free faces 52 and 54 created by removal of the side pillars in the upper and lower voids; that is, toward spaces previously occupied by the side pillars.

Thus, the upper and lower void spaces are excavated so that the span in each void is less than the total distance between opposite side boundaries of the retort site. The reduced span can enhance safety within the void space when compared with a horizontal void having a wider span excavated to the entire outer periphery of the retort site. The side pillars within the boundaries of the retort site adjacent the voids are explosively expanded just prior to expanding the principal zones of formation toward the horizontal voids for forming the fragmented mass. Thus, the free faces adjacent the upper and lower voids are, in effect, enlarged to match the entire horizontal cross section of the retort being formed, just prior to explosively expanding the zones of unfragmented formation toward the free faces.

Eliminating interior roof-supporting pillars from such a horizontal void significantly improves the mining efficiency and production rate and permits ease of access for drilling and loading the vertical blast holes 42 into the lower zone of unfragmented formation from the floor of the upper (or intermediate) void immediately adjacent the lower zone of formation. Similarly, the vertical blast holes for the explosive charges 46 can be drilled from access provided in the void space (not shown) immediately above the upper zone 26 of unfragmented formation. By eliminating the interior pillars in this manner, the necessity of drilling long blast holes to reach oil shale below such interior pillars is eliminated. Side pillars can also be advantageous in voids having large height. Pillars within such a high void need to be wide to have a sufficiently low height-to-width ratio to be structurally stable. This constraint is not present in side pillars which have lateral support from unfragmented formation between adjacent retort sites.

Use of the side pillars is acceptable in an embodiment in which there is no need for placing explosive charges in the zone of unfragmented formation near all four side boundaries of the retort site. By eliminating these outer rows of blast holes, in which the use of explosive charges can be inefficient anyway, the number of blast holes drilled and the quantity of explosive used can be greatly reduced, without any appreciable reduction in the quantity of oil shale formation effectively fragmented. Stated another way, the pillar width required for safe roof support is sufficiently narrow (at most, one crater radius) that blast holes at the outer periphery of the array are still effective in fragmenting a reasonable amount of the shale within the retort site. The vertical explosive charges, being spaced inwardly from the side boundaries due to limited access beneath the edge pillars, limits the lateral extent of explosive expansion near the midplane of the lower zone 20. In effect, there is a sloping crater from the vicinity of the middle of the explosive charges toward the intersection of the side boundaries and the new free faces 52 and 54. As a result, a region 58 of unfragmented formation having a narrowed shape somewhat as illustrated in phantom lines at 60 in FIG. 2 extends inwardly from each of the opposite side boundaries 12 and 13 in the region of the intervening zone 20. Thus, in this region the width of the fragmented mass in the retort is somewhat less than the width of the fragmented mass in the vicinity of the excavated voids. Similar regions 62 with narrowed side boundaries 64 are formed in the region of the fragmented mass above the elevation of the upper (or intermediate) void 18. Additional disclosure of embodiments of in situ oil shale retorts of this slope side type is contained in U.S. patent application Ser. No. 227,588, entitled "Horizontal Free Face Blasting for Minimizing Channeling and Mounding", filed Jan. 23, 1981, by Thomas E. Ricketts and assigned to the assignee of this application. Said patent application is hereby incorporated by reference.

If it is desired to reduce the size of the regions 58 and 62 of unfragmented formation adjacent the zones being blasted toward the horizontal voids, additional blast holes can be slant drilled downwardly and diagonally outwardly from the void above each zone toward the side boundaries of the retort site, thereby placing edge charges somewhat nearer the side boundary than feasible with only vertical blast holes. Also, the void levels can be designed to allow vertical blast holes to be drilled along the side boundaries, if desired.

Figure 3:
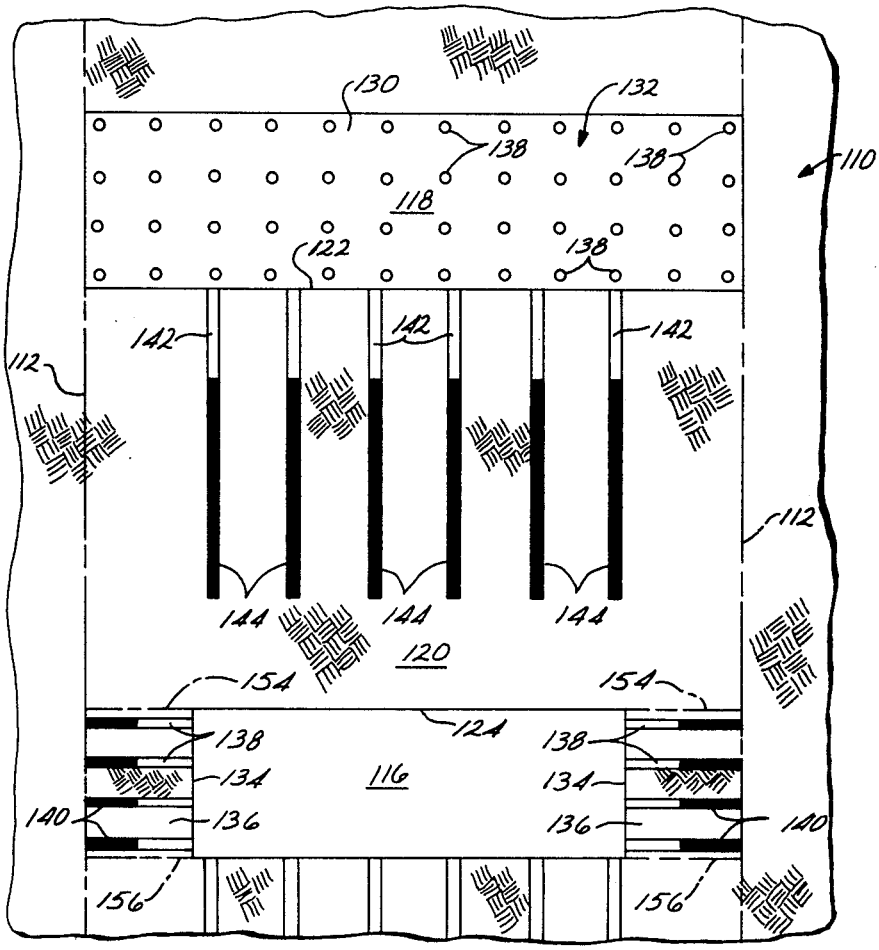
FIG. 3 is a fragmentary, semi-schematic vertical cross-sectional view showing an alternative embodiment of carrying out the method of this invention.

Although in the embodiment illustrated in FIG. 1 and 2, the side pillars in the upper and lower voids are above one another, extending along the same side boundaries of the retort, it will be apparent that, if desired, the side pillars can be along different edges of voids excavated at different levels. FIG. 3 illustrates an example of such an alternative embodiment, in which reference numerals referring to elements comparable to the arrangement of FIGS. 1 and 2 are increased by 100 in FIG. 3. In this alternative embodiment, side pillars 132 along opposite sides of an upper void 118 extend between the opposite side boundaries 112 of the retort, while side pillars 136 along opposite sides of a lower void 116 extend between the other pair of the side boundaries of the retort. Otherwise, the fragmented mass is formed in the manner similar to the embodiment of FIGS. 1 and 2. An array of blast holes 142 can be drilled into the zone 120 from the floor 122 of the upper void. The outermost rows of blast holes in the array are all spaced inwardly from the side boundaries of the retort site, with vertical blast holes at the periphery of the retort site being eliminated. Explosive charges in the side pillars are detonated for explosively expanding formation from within the side pillars toward the horizontal voids prior to explosively expanding the zones of unfragmented formation toward the horizontal voids for forming the fragmented mass.

In one embodiment, side pillars can be left along all four sides of the retort, edge charges can be placed alongside each of the side pillars, and horizontal blast holes and corresponding explosive charges can be placed in each side pillar in a manner similar to FIGS. 1 and 2. Two side pillars on opposite sides of the retort are blasted first and then the remaining opposite side pillars are blasted.

In another embodiment of the technique for forming an in situ oil shale retort wherein side pillars are left adjacent a void, a zone of unfragmented formation above the void is explosively expanded toward the void in a plurality of layers. An exemplary embodiment is illustrated in semi-schematic vertical cross section in FIG. 4.

A technique for forming an in situ oil shale retort by explosively expanding formatin in layers downwardly to an underlying void is disclosed in U.S. patent application Ser. No. 234,014 now U.S. Pat. No. 4,349,227 entitled "Two Level Mining System For In Situ Oil Shale Retorts", filed Feb. 12, 1981, by William D. Langford. Another technique is described in U.S. patent application Ser. No. 246,232, now abandoned, entitled "Two Level, Horizontal Free Face Mining System For In Situ Oil Shale Retorts", filed Mar. 23, 1981, by Chang Yul Cha. Said applications are owned by the assignee of this application and hereby incorporated by this reference.

Figure 4:
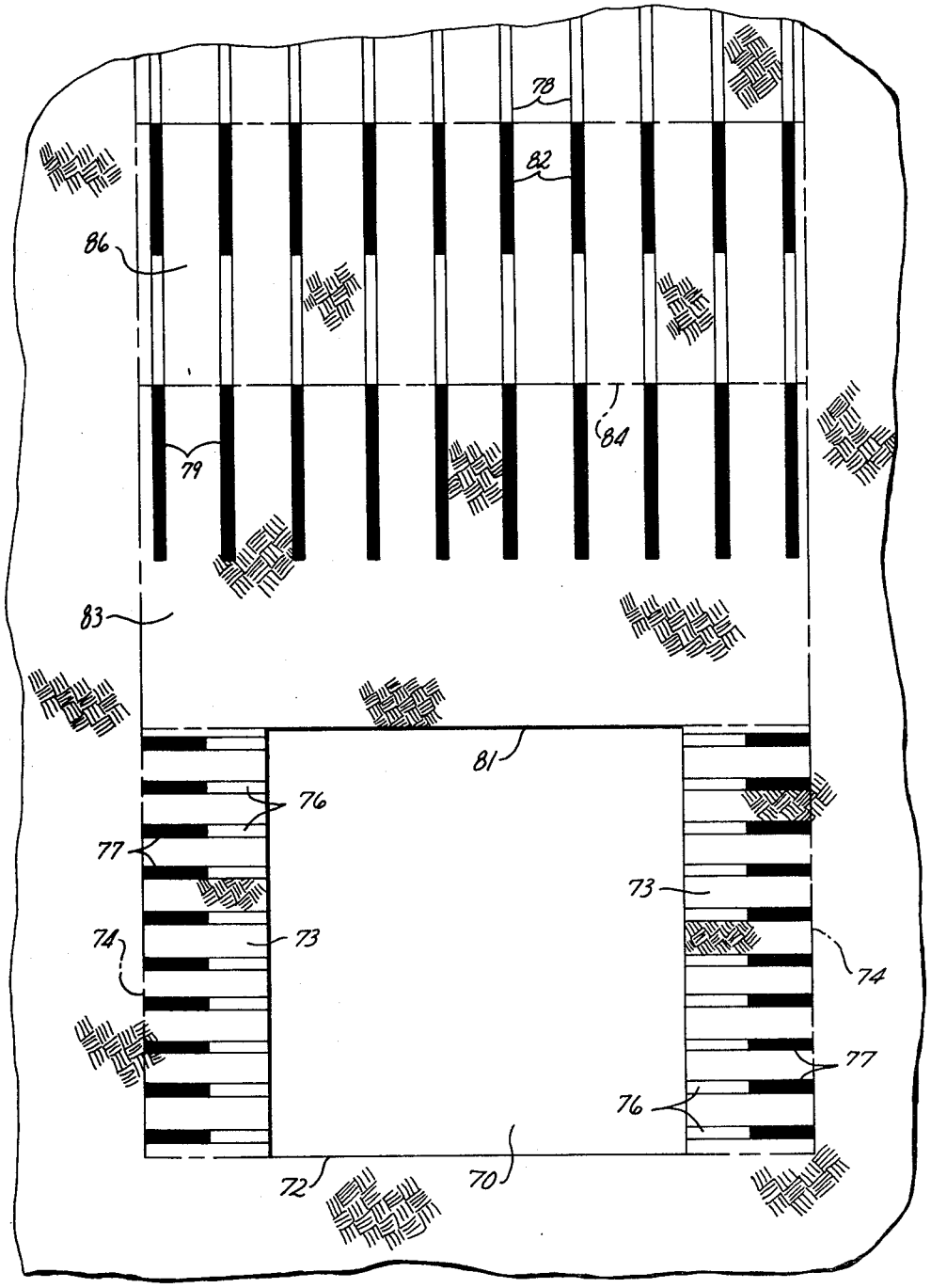
FIG. 4 is a fragmentary, semi-schematic vertical cross-sectional view of another embodiment of practice of this invention.

In the embodiment illustrated in FIG. 4, a void 70 is excavated adjacent the lower boundary 72 of an in situ oil shale retort site. Assuming a retort about 160 feet square is being formed, the void has a length of about 160 feet extending to the side boundaries of the retort site. The width of the void can, for example, by about 100 feet, leave side pillars 73 extending along opposite side boundaries 64 of the retort site. Such a void can be 100 feet or more in height without developing instability in the 30 foot wide side pillars.

During excavation of the void, horizontally extending blast holes 76 are drilled in the side pillars 73 to the side boundary of the retort site. Following excavation, explosive charges 77 are placed in about one-half the length of each of the blast holes and the balance of the length is stemmed. Alternatively, vertical blast holes can be drilled from above and corresponding vertical charges can be placed in the blast holes in side the pillars 73 for use in blasting the side pillars toward the void space 70.

Additional blast holes 78 are drilled from above into the zone of unfragmented formation overyling the void. Such blast holes can be drilled from the ground surface or from underground workings (not shown) at elevations above the retort or adjacent the top boundary of the retort being formed. An explosive charge 79 is placed in the bottom of each of the blast holes 78 in the zone of unfragmented formation overlying the void. In an exemplary embodiment, the length of each of the explosive charges 79 is about the same as the distance between the bottom of such explosive charge and the free face 81 at the roof of the void. Inert stemming is placed in the blast holes 78 above the lower explosive charges 79 and an additional array of explosive charges 82 is placed in the blast holes above the stemming. If desired, additional explosive charges (not shown) can be placed in the blast holes for explosively expanding additional layers of formation toward the underlying void. A fragmented permeable mass of formation particles is formed in the retort by detonating the explosive charges. Initially the explosive charges 77 in the side pillars 73 are detonted for explosively expansing the side pillars toward the void. After a suitable time, on the order of tens to hundreds of milliseconds, the explosive charges 79 in the bottom of the blast holes in the zone of unfragmented formation over the void are detonated in a desired delay sequence. This results in explosive expansion of a first layer 83 of formation toward the void and creation of a new free face 84 at the top of the expanded layer.

After an additional time delay, the next array of explosive charges 82 is detonated in a desired delay sequence for explosively expanding the next layer 86 toward the void. Additional layers can be similarly explosively expanded for forming a fragmented permeable mass of formation particles in the in situ oil shale retort.

As a further alternative embodiment, formation can be excavated from within the retort site to provide side pillars in void spaces at alternating levels, with interior pillars being provided in the void spaces at intervening levels. In another variation, combinations of both side pillars and interior pillars can be left within the void spaces at all levels of the retort site.

In another embodiment of the technique for forming an in situ oil shale retort wherein side pillars are left adjacent a void space, existing retorts containing a fragmented mass can be enlarged. In this technique, the walls of formation adjacent the existing fragmented mass serve as load-supporting side pillars. Formation is excavated from adjacent the sides of the existing fragmented mass to form one or more void spaces, and formation left adjacent the voids serves as the side pillars. The side pillars are blasted toward the new void spaces and then formation in the zones of formation above and/or below the void spaces is blasted toward the voids for forming the enlarged fragmented mass.

During retorting operations, a combustion zone is established in the fragmented mass, and the combustion zone is advanced downwardly through the fragmented mass by introducing an oxygen-supplying gas into the upper portion of the fragmented mass. Combustion gas produced in the combustion zone passes through the fragmented mass to establish a retorting zone on the advancing side of the combustion zone, wherein kerogen in the oil shale is retorted to produce liquid and gaseous products of retorting. The liquid products and an off gas containing gaseous products pass to the bottom of the fragmented mass and are withdrawn to a main production level drift system through separate product withdrawal drifts (not shown). The liquid products can be withdrawn from the production drift system to above ground. Off gas is withdrawn from the production drift system and also passed to aboveground.

What is claimed is:

1. A method for recovering liquid and gaseous products from an in situ oil shale retort formed within upper, lower, and vertically extending side boundaries of a retort site in a subterranean formation containing oil shale, such an in situ oil shale retort containing a fragmented permeable mass of formation particles containing oil shale, comprising the steps of:

excavating formation from within the retort site for forming at least one void extending horizontally across the retort site, the width of the void being less than the distance between a pair of opposite vertically extending side boundaries of the retort site, leaving at least a pair of roof-supporting side pillars of unfragmented formation within the retort site along opposite sides of the horizontal void, the side pillars providing roof support for unfragmented formation within the retort site above the void, the side pillars having peripheral interior walls at opposite ends of the void spaced inwardly from the vertical side boundaries of the retort site; and leaving at least one zone of unfragmented formation within the retort site above or below the horizontal void;

placing an array of explosive charges in such a zone of unfragmented formation, wherein edge charges in said array are spaced inwardly from the side boundaries of the retort site adjacent the side pillars, the edge charges being placed adjacent the interior walls of the side pillars;

placing explosive charges in the side pillars along opposite sides of the void;

initiating detonation of explosive in the side pillars prior to initiating detonation of explosive in the zone of unfragmented formation, for explosively expanding the side pillars toward the void prior to explosively expanding the zone of unfragmented formation toward the horizontal void for forming a fragmented permeable mass of formation particles containing oil shale in the in situ oil shale retort;

establishing a retorting zone in an upper portion of the fragmented mass;

introducing a retorting gas into the fragmented mass for sustaining the retorting zone and for advancing the retorting zone through the fragmented mass; and withdrawing liquid and gaseous products from a lower portion of the fragmented mass on the advancing side of the retorting zone.

2. The method according to claim 1 including placing the explosive charges in the zone of unfragmented formation by drilling a plurality of mutually spaced-apart blast holes in said zone via access provided from within the horizontal void, and placing the explosive charges in the blast holes drilled in the zone of unfragmented formation.

3. The method according to claim 2 including placing the explosive charges in the side pillars by drilling a plurality of mutually spaced-apart blast holes in said side pillars via access provided from within the horizontal void, and placing the explosive charges in the blast holes drilled in the pillars.

4. The method according to claim 1 wherein the edge charges in the zone of unfragmented formation comprise essentially vertical columnar explosive charges in rows adjacent the interior walls of the side pillars.

5. The method according to claim 1 including leaving such side pillars along all sides of the void, and explosively expanding a pair of side pillars on opposite sides of the void just prior to explosively expanding the remaining pair of opposite side pillars, followed by explosively expanding the zone of formation toward the void.

6. The method according to claim 1 wherein the edge charges in the zone of unfragmented formation comprise explosive charges in blast holes drilled diagonally from an edge of such a void toward a side boundary of the retort site.

7. A method for forming an in situ oil shale retort site within a subterranean formation containing oil shale such as in situ retort containing a fragmented permeable mass of formation particles containing oil shale formed within upper, lower, and vertically extending side boundaries of the retort site, comprising the steps of:

excavating formation from within the retort site for forming at least one void extending horizontally across the retort site, opposite peripheral interior walls of the horizontal void being spaced inwardly from adjacent vertically extending side boundaries of the retort site for providing roof-supporting side pillars of unfragmented formation within the retort site at least along opposite sides of the horizontal void, the horizontal void having an entirely open roof span, free from any isolated roof-supporting pillars between the peripheral interior walls of the void; and leaving a zone of unfragmented formation within the side boundaries of the retort site adjacent the horizontal void;

placing explosive charges in the side pillars;

placing an array of explosive charges in the zone of unfragmented formation adjacent the void, said array of explosive charges having edge charges placed in rows extending adjacent to the peripheral interior walls of the horizontal void;

detonating the explosive charges in the side pillars; and thereafter detonating the explosive charges in the zone of unfragmented formation for explosively expanding at least a portion of the zone of unfragmented formation toward the horizontal void for forming a fragmented permeable mass of formation particles containing oil shale within the in situ oil shale retort.

8. The method according to claim 7 including placing the explosive charges in the zone of unfragmented formation by drilling an array of blast holes into the zone of unfragmented formation via access provided from within the horizontal void, and placing explosive charges in the blast holes.

9. A method for forming an in situ oil shale retort in a retort site in a subterranean formation containing oil shale, such as in situ retort containing a fragmented permeable mass of formation particles containing oil shale formed within upper, lower and vertically extending side boundaries of the retort site, comprising the steps of:

excavating formation from within the retort site for forming at least one void extending horizontally across the retort site, the width of such void being less than the distance between a pair of opposite vertically extending side boundaries of the retort site, leaving side pillars of unfragmented formation between peripheral interior walls at opposite sides of the horizontal void and said pair of opposite side boundaries of the retort site, and leaving zones of unfragmented formation within the side boundaries of the retort site above and below the void, the zones of unfragmented formation above and below the void having upper and lower horizontal free faces adjacent the void, respectively, the side pillars providing roof support within the void for the zone of unfragmented formation above the void;

explosively expanding the side pillars toward the horizontal void for enlarging the horizontal areas of said upper and lower horizontal free faces out to the vicinity of said pair of opposite side boundaries of the retort site; and thereafter explosively expanding at least a portion of the zones of unfragmented formation downwardly and upwardly toward the enlarged upper and lower free faces for forming a fragmented permeable mass of formation particles containing oil shale within the in situ oil shale retort.

10. The method according to claim 9 including excavating the horizontal void so the void is entirely open between the interior peripheral walls of the void.

11. The method according to claim 9 including placing explosive charges in the side pillars and in the zone of unfragmented formation below the void from access provided from within the horizontal void, and detonating said explosive charges for expanding the side pillars and the zone of formation above or below the void.

12. The method according to claim 9 including excavating the void with a horizontal roof span such that the combined width of the side pillars is sufficient to provide safe roof support for the zone of unfragmented formation above the void.

13. A method for forming an in situ oil shale retort in a retort site within a subterranean formation containing oil shale, such an in situ oil shale retort containing a fragmented permeable mass of formation particles containing oil shale formed within upper, lower, and vertically extending side boundaries of the retort site, comprising the steps of:

excavating at least one void extending horizontally across the retort site, the void having interior walls at its periphery, such a void having a width less than the distance between opposite vertical side boundaries of the retort site, leaving a zone of unfragmented formation within the retort site having a horizontally extending free face adjacent such void, and leaving roof-supporting side pillars of unfragmented formation between a peripheral interior wall of each side pillar and the adjacent vertically extending side boundaries of the retort site;

explosively expanding the side pillars toward the horizontal void; and thereafter;

explosively expanding at least a portion of the zone of unfragmented formation toward the horizontal void, including spaces in the retort site previously occupied by such expanded side pillars, for forming a fragmented permeable mass of formation particles contining oil shale in the in situ oil shale retort.

14. The method according to claim 13 including excavating the void with a horizontal span such that the combined width of the side pillar or pillars is sufficient to provide safe roof support for unfragmented formation overlying the void.

15. The method according to claim 13 including providing a pair of such side pillars on opposite sides of the retort, and placing an array of explosive charges in the zone of unfragmented formation, said array having edge charges spaced inwardly from the vertically extending side boundaries on the same sides of the retort site as the side pillars; and explosively expanding the zone of unfragmented formation by detonating the explosive charges.

16. The method according to claim 15 including spacing edge charges of explosive from each of the adjacent side boundaries of the retort not having such side pillars by a distance approximately equal to the width of the side pillars.

17. A method for forming an in situ oil shale retort in a subterranean formation containing oil shale, such an in situ oil shale retort containing a fragmented permeable mass of formation particles containing oil shale formed within upper, lower and vertically extending side boundaries of the retort site, comprising the steps of:

excavating formation from within the retort site for forming at least one void extending horizontally across the retort site, such void having a width less than the distance between opposite side boundaries of the retort site, leaving side pillars of unfragmented formation within the retort site along opposite sides of the void, said side pillars having interior walls at the periphery of the void; and leaving a zone of unfragmented formation within the retort site having a horizontally extending free face adjacent the void;

drilling a plurality of mutually spaced-apart blast holes in the side pillars along opposite sides of the horizontal void;

drilling an array of mutually spaced-apart vertical blast holes in the zone of unfragmented formation, said array of vertical blast holes having outer rows of blast holes which are spaced inwardly from said opposite side boundaries of the retort site by approximately the same distance that the peripheral interior walls of the side pillars are spaced inwardly from said opposite side boundaries of the retort site;

placing explosive charges in the array of blast holes in the zone of unfragmented formation;

placing explosive charges in the blase holes in the side pillars;

detonating the explosive charges in the side pillars for explosively expanding the side pillars toward the horizontal void; and thereafter detonating the explosive charges in the zone of unfragmented formation for explosively expanding at least a portion of the zone of unfragmented formation toward the horizontal void and toward the spaces previously occupied by the side pillars for forming a fragmented permeable mass of formation particles containing oil shale within the in situ retort.

18. The method according to claim 17 including leaving the horizontal void entirely open between the interior walls of the side pillars.

19. The method according to claim 17 including placing the explosive charges in the side pillars near the boundaries of the retort site for explosively expanding the side pillars out to the vicinity of the side boundaries of the retort site.

20. The method according to claim 17 including drilling the vertical blast holes in the zone of unfragmented formation via access provided from within the horizontal void.

21. A method for forming an in situ oil shale retort in a retort site within a subterranean formation containing oil shale, such an in situ oil shale retort containing a fragmented permeable mass of formation particles containing oil shale formed wihtin upper, lower, and vertically extending side boundaries of the retort site, comprising the steps of:

excavating formation from within the retort site for forming at least one void extending horizontally across the retort site, leaving a zone of unfragmented formation within the retort site adjacent the horizontal void, and leaving roof-supporting side pillars of unfragmented formation within the retort site along opposite peripheral side walls of the horizontal void so that the width of the void is less than the distance between opposite vertical side boundaries of the retort site, said peripheral side walls being spaced inwardly from opposite vertically extending side boundaries of the retort site;

placing an array of exlosive charges in each of the side pillars;

drilling an array of mutually spaced-apart vertical blast holes in the zone of unfragmented formation via access provided from within the void;

placing explosive charges in the array of blast holes in the zone of unfragmented formation;

detonating the explosive charges in the side pillars for explosively expanding the side pillars toward the horizontal void; and thereafter detonating the explosive charges in the zone of unfragmented formation for explosively expanding at leat a portion of the zone of unfragmented formation toward the horizontal void for forming a fragmented permeable mass of formation particles containing oil shale within an in situ oil shale retort.

22. The method according to claim 21 including drilling the array of blast holes so that the outer rows of blast holes are spaced inwardly from said opposite side boundaries by approximately the width of the side pillars.

23. The method according to claim 22 in which the retort site is generally rectangular in horizontal cross section having a first pair of side boundaries on opposite sides of the retort site and having a second pair of side boundaries on the other side boundaries of the retort site; and including drilling the array of blast holes in the zone of unfragmented formation on a rectangular array in which first opposite rows of outer blast holes are along the opposite peripheral side walls of the void, and second opposite rows of outer blast holes are spaced inwardly from the second pair of opposite side boundaries of the retort site.

24. The method according to claim 23 including spacing the second opposite rows of outer blast holes inwardly from the second pair of opposite side boundaries by a distance approximately equal to the width of the side pillars.

25. The method according to claim 22 including explosively expanding each such side pillar widthwise out to the adjacent first boundary of the retort site and lengthwise out to the opposite second side boundaries of the retort site.

26. An in situ oil shale retort sytem in an intermediate stage of preparation within upper, lower, and vertically extending side boundaries of a retort site within a subterranean formation containing oil shale, the in situ retort sytem being prepared for explosive expansion of formation within the retort site for forming a fragmented permable mass of formation particles containing oil shale within an in situ oil shale retort, the in situ retort system comprising:

a horizontally extending void excavated in formation within the retort site, the horizontal void having a width less than the distance between a pair of opposite vertical side boundaries of the retort site;

side pillars of unfragmented formation within the retort site along opposite sides of the horizontal void, the side pillars providing interior peripheral side walls at opposite sides of the horizontal void, the side pillars providing roof support for unfragmented formation overlying the horizontal void, the interior peripheral side walls of the horizontal void being spaced inwardly from said pair of opposite vertical side boundaries of the retort site;

a zone of unfragmented formation wtihin the side boundaries of the retort site having a horizontally extending free face adjacent the horizontal void, the zone of unfragmented formation having a width extending between said pair of opposite side boundaries of the retort site;

an array of vertically extending blast holes in the zone of unfragmented formation;

an array of horizontally extending blast holes in the side pillars adjacent the void;

explosive charges in the blast holes in the side pillars for explosively expanding the side pillars toward the horizontal void; and explosive charges in the vertical blast holes for explosively expanding at least a portion of the zone of unfragmented formation toward the horizontal void.

27. The in situ retort system according to claim 26 wherein the array of blast holes in the zone of unfragmented formation has outer rows of blast holes spaced inwardly from said pair of opposite side boundaries of the retort site.

28. The in situ retort system according to claim 27 in which the outer rows of such vertical blast holes extend downwardly into such a zone of unfragmented formation adjacent the interior side walls of the side pillars.

29. The in situ retort system according to claim 27 in which the outer rows of said blast holes are spaced inwardly from said opposite pair of side boundaries by a distance approximately equal to the width of the side pillars.

30. The in situ oil shale retort system according to claim 26 in which the depth of the explosive charges in the blast holes drilled in the side pillars extends to approximately said opposite pair of side boundaries of the retort site.

31. An in situ oil shale retort system formed within upper, lower and vertically extending side boundaries of a retort site within a subterranean formation containing oil shale, the in situ retort system being prepared for explosive expansion of formation within the retort site or forming an in situ oil shale retort containing a fragmented permeable mass of formation particles containing oil shale, the in situ oil shale retort system comprising:

an upper horizontal void excavated in the retort site, the upper horizontal void extending across the retort site and having a width less than the distance between a pair of opposite side boundaries of the retort site;

a lower horizontal void excavated in the retort site at an elevation below the upper void, the lower void having a width less than the distance between opposite side boundaries of the retort site;

first side pillars of unfragmented formation within the upper void extending along opposite sides of the upper void, the first side pillars forming interior peripheral walls of the upper void which are spaced inwardly from opposite side boundaries of the retort site;

second side pillars of unfragmented formation within the retort site extending along opposite sides of the lower void, the second side pillars forming interior peripheral walls of the lower void which are spaced inwardly from opposite side boundaries of the retort site;

a zone of unfragmented formation within the side boundaries of the retort site extending between the upper void and the lower void;

an array of vertical blast holes drilled downwardly in the zone of unfragmented formation from the upper void, the array having outer rows of blast holes spaced inwardly from the same opposite side boundaries of the retort site along which the first side pillars extend;

explosive charges placed in the first side pillars for explosively expanding the first side pillars toward the upper void;

explosive charges placed in the second side pillars for explosively expanding the second side pillars toward the lower horizontal void; and explosive charges placed in the vertical blast holes in the zone of unfragmented formation for explosively expanding the zone of unfragmented formation upwardly toward the upper void and downwardly toward the lower void after explosive expansion of the side pillars.

32. The in situ oil shale retort system according to claim 31 in which the first side pillars and the second side pillars extend along the same pair of opposite side boundaries of the retort site.

33. The in situ oil shale retort system according to claim 31 in which the first side pillars extend along one pair of opposite side boundaries of the retort site and the second side pillars extend along another pair of opposite side boundaries of the retort site.

34. A method for recovering liquid and gaseous products from an in situ oil shale retort formed within upper, lower, and vertically extending side boundaries of a retort site in a subterranean formation containing oil shale, such an in situ oil shale retort containing a fragmented permeable mass of formation particles containing oil shale comprising the steps of:

excavating formation from within the retort site for forming at least one void extending horizontally across the retort site, leaving at least a pair of roof-supporting side pillars of unfragmented formation within the retort site along opposite sides of the horizontal void, the side pillars providing roof support for unfragmented formation within the retort site above the void, the side pillars having interior walls within the void spaced inwardly from side boundaries of the retort site adjacent the side pillars, said interior walls being at the periphery of the horizontal void, and leaving at least one zone of unfragmented formation within the retort ite above or below the horizontal void; the horizontal void being excavated with an entirely open roof span, free from any isolated roof-supporting pillars in the void space between the interior walls of the side pillars;

placing an array of explosive charges in such a zone of unfragmented formation, wherein edge charges in said array are spaced inwardly from the side boundaries of the retort site adjacent the side pillars, the edge charges being placed adjacent the interior walls of the side pillars;

placing explosive charges in the side pillars along opposite sides of the void;

initiating detonation of explosive in the side pillars prior to initiating detonation of explosive in the zone of unfragmented formation, for explosively expanding the side pillars toward the void prior to explosively expanding the zone of unfragmented formation toward the horizontal void for forming a fragmented permeable mass of formation particles containing oil shale in the in situ oil shale retort;

establishing a retorting zone in an upper portion of the fragmented mass;

introducing a retorting gas into the fragmented mass for sustaining the retorting zone and for advancing the retorting zone through the fragmented mass; and withdrawing liquid and gaseous products from a lower portion of the fragmented masss on the advancing side of the retorting zone.

35. A method for forming an in situ oil shale retort in a retort site within a subterranean formation containing oil shale, such an in situ oil shale retort containing a fragmented permeable mass of formation particles containing oil shale formed within upper, lower, and vertically extending side boundaries of the retort site, comprising the steps of:

excavating at least one void extending horizontally across the retort site, the void having interior walls at its periphery, leaving a zone of unfragmented formation within the retort site having a horizontally extending free face adjacent such void, the void having a smaller horizontal cross-sectional area defined within its peripheral interior walls than the horizontal cross-sectional area of the zone of unfragmented formation, and leaving at least one roof-supporting side pillar of unfragmented formation between such interior wall of the void and the vertically extending side boundary of the retort site; the horizontal void being excavated with an entirely open void space free of any roof-supporting pillars;

explosively expanding such a side pillar toward the horizontal void; and thereafter;

explosively expanding at least a portion of the zone of unfragmented formation toward the horizontal void, including spaces in the retort site previously occupied by such expanded side pillar, for forming a fragmented permeable mass of formation particles contining oil shale in the in situ oil shale retort.

36. An in situ oil shale retort system in an intermediate stage of preparation within upper, lower, and vertically extending side boundaries of a retort site within a subterranean formation containing oil shale, the in situ retort system being prepared for explosive expansion of formation within the retort site for forming a fragmented permable mass of formation particles containing oil shale within an in situ oil shale retort, the in situ retort system comprising:

a horizontally extending void excavated in formation within the retort site, the horizontal void having a width less than the distance between a pair of opposite side boundaries of the retort site;

side pillars of unfragmented formation within the retort site along opposite sides of the horizontal void, the side pillars providing roof support for unfragmented formation overlying the horizontal void, the side pillars forming interior peripheral walls of the horizontal void spaced inwardly from said pair of opposite side boundaries of the retort site; the horizontal void being excavated with an entirely open void space between the side pillars;

a zone of unfragmented formation wtihin the side boundaries of the retort site having a horizontally extending free face adjacent the horizontal void the zone of unfragmented formation having a width extending between said pair of opposite side boundaries of the retort site;

an array of vertically extending blast holes in the zone of unfragmented formation;

an array of horizontally extending blast holes in the side pillars adjacent the void;

explosive charges in the blast holes in the side pillars for explosively expanding the side pillars toward the horizontal void; and explosive charges in the vertical blast holes for explosively expanding at least a portion of the zone of unfragmented formation toward the horizontal void.

* * * * *